United States Patent [19]

Lami

[11] Patent Number: 4,756,322

[45] Date of Patent: Jul. 12, 1988

[54] MEANS FOR RESTORING THE INITIAL CLEANNESS CONDITIONS IN A QUARTZ TUBE USED AS A REACTION CHAMBER FOR THE PRODUCTION OF INTEGRATED CIRCUITS

[76] Inventor: Philippe A. Lami, 22 Alleé du Pré Blanc, 38240 Meylan, France

[21] Appl. No.: 930,267

[22] PCT Filed: Mar. 4, 1986

[86] PCT No.: PCT/FR86/00069

§ 371 Date: Oct. 30, 1986

§ 102(e) Date: Oct. 30, 1986

[87] PCT Pub. No.: WO86/05129

PCT Pub. Date: Sep. 12, 1986

[30] Foreign Application Priority Data

Mar. 8, 1985 [FR] France ..... 8503433

[51] Int. Cl.[4] ..... B08B 3/00; B08B 9/02

[52] U.S. Cl. ..... 134/86; 134/88; 134/99; 134/115 R; 134/157; 134/170

[58] Field of Search ..... 134/86, 88, 91, 92, 134/95, 99, 115 R, 157, 170, 200; 68/210; 414/217

[56] References Cited

U.S. PATENT DOCUMENTS 3,893,869 7/1975 Mayer et al. ..... 134/86
4,294,271 10/1981 Intrater et al. ..... 134/200 X
4,561,268 12/1985 Southwick et al. ..... 68/210

FOREIGN PATENT DOCUMENTS

A2818895 10/1979 Fed. Rep. of Germany .
A2418034 9/1979 France .

OTHER PUBLICATIONS

Patents Abstracts of Japan, vol. 7, No. 240 (M-251) (1385), 25-Oct.-1983 and JP, A, 58127035 (Hitachi), 28-Jul.-1983.

*Primary Examiner*—Philip R. Coe
*Attorney, Agent, or Firm*—Oblon, Fisher, Spivak, McClelland & Maier

[57] ABSTRACT

A vertical panel (1) separates the shop into an average cleanness zone (2) and a maximum cleanness zone (3). An elongated tank (4) is located in the zone (2) and an enclosure (6) is inserted in an opening (5) in the panel (1). The tubes are cleaned and prerinsed in the tank (4), then rinsed and dried in the enclosure (6), which also serves as a lock for the transfer of the tubes between the zones (2) and (3).

15 Claims, 3 Drawing Sheets

MEANS FOR RESTORING THE INITIAL CLEANNESS CONDITIONS IN A QUARTZ TUBE USED AS A REACTION CHAMBER FOR THE PRODUCTION OF INTEGRATED CIRCUITS

FIELD OF THE INVENTION

The present invention relates to a means for restoring the initial cleanness conditions in a quartz tube used as a reaction chamber or reactor for the production of integrated circuits. The invention is more particularly applied in mass production units for integrated circuits.

BACKGROUND OF THE INVENTION

In such units, one of the essential conditions to be respected in the absolute cleanness of the ambient air. This cleanness is evaluated by the detection of a very small number of particles with a size exceeding 0.5 microns in a unitary air volume and by the substantially total absence of corrosive gas in the ambient air. Such rooms, called "white rooms", have very high production and operating costs, so that the following factors should be limited;

(1) The ground surface or volume occupied by the machines contained in the white room.

(2) The air quantity force-extracted from the white room, because this involves the introduction into the white room of an equal quantity of air treated and filtered by absolute filters, which is very onerous. Such an air extraction is mainly brought about by exhauster hoods over the machines producing the polluting emanations.

(3) The air quantity escaping from the white room during the opening thereof, particularly during the introduction into it of large parts, because the white room is under an overpressure.

(4) The white room opening frequency, because this always leads to a drop in the overpressure and causes movements which introduce dust.

(5) The liquid or corrosive gas quantity able to escape into the air of the white room.

Furthermore certain machines, such as deposition furnaces, are present in the white room. A deposition furnace essentially comprises a quartz tube serving as a reaction chamber. Each deposition furnace must be periodically extracted and treated to remove the deposits from its surface. This cleaning operation (or, more precisely, the operation of restoring the initial cleanness conditions) consists of immersing the tube in a stirred bath of extremely corrosive chemical products, generally a hot, concentrated mixture of HF and $HNO_3$. In this way, it is possible to remove tungsten deposits, which are particularly resistant.

As quartz tubes are very fragile and long (i.e., approximately two to three meters, the cleaning operation is difficult. Treatment of the tube in the white room takes up space, requires a large air extraction for limiting the contamination of the air by the corrosive emanations and does not completely eliminate the risk of damaging the quartz tubes.

A treatment outside the white room involves handling the tube for removing it and returning it to the room. This entails the risk of dust or polluting materials being deposited on the tube during its stay outside the white room. Moreover, in this case the handling of the tube for removing it and returning it to the white room requiring a significant opening of the room. This entails a high consumption of filtered air and a pressure drop within the white room.

OBJECT OF THE INVENTION

The object of the present invention is to provide a means for cleaning quartz tubes making it possible to avoid the disadvantages of treating the tube in the white room and treating it outside the white room.

SUMMARY OF THE INVENTION

According to the invention, the cleaning means comprises a vertical separating panel defining on one side a first zone in the integrated circuit production shop the air of which is filtered to obtain an average cleanness level and on the other side a second zone in the production shop the air of which is filtered to obtain a maximum cleanness level. The second zone is called the white room and is where the main production operations are carried out. The second zone includes the production machines using the quartz tubes and an elongated tank open in its upper part and located against the vertical separating panel. The elongated open tank contains the chemical product or products for eliminating the undesirable elements covering the quartz tubes. In an opening in the vertical separating panel is sealingly inserted an elongated parallelepipedic enclosure which functions as a rinsing and drying enclosure. The rinsing and drying enclosure is positioned vertically and is sized and shaped to receive a quartz tube. The rinsing and drying enclosure also has a door opening on the first zone and a door opening on the second zone. The two doors face one another and have a height exceeding the length of the quartz tube. Preferably, the vertical separating elongated panel, the elongated tank, and the rinsing and drying enclosure are produced separately and rigidly assembled to form the complete cleaning installation.

According to another feature of the invention, the elongated tank is fixed, cylindrical, and surmounted by a horizontal shaft. The axis of which coincides with the geometrical axis of the elongated tank. The elongated tank is provided with two arches rigidly connected thereto. The two arches have a curvature the centre of which coincides with the axis of the elongated tank. The quartz tube is immersed in the chemical treatment liquid contained in the elongated tank whilst resting on the two arches. The agitation of the quartz tube is obtained by oscillating the horizontal shaft, so that by running on the arches the oscillation of the quartz tube is produced. The elongated tank and the horizontal shaft are surrounded by a protective enclosure provided in its upper part with a vapour exhauster hood and having on the outside of its lateral part an electric motor mechanism for giving the oscillating movement to the horizontal shaft.

According to an embodiment of the invention, the rinsing and drying enclosure is fitted into the vertical separating panel so as to project by a substantially identical distance on either side thereof. The elongated tank is located in the vicinity of the rinsing and drying enclosure, and the axis of the elongated tank is perpendicular to the vertical plane of the vertical separating panel.

According to another feature of the invention, the rinsing and drying enclosure has a substantially planar, horizontal wall subdividing it into a lower compartment and an upper compartment, whereby the quartz tube can rest on the horizontal wall in the vertical position when n the upper compartment. The horizontal wall has at least one opening issuing into the quartz tube and at least one opening issuing outside the quartz tube when the quartz tube rests on the horizontal wall in the vertical position. In this case the rinsing and drying enclosure may also comprise an admission duct for the drying gas from the quartz tube issuing into the lower compartment and a drying gas discharge duct communicating with the upper compartment.

According to another feature of the invention, the rinsing and drying enclosure comprises a rinsing tube having a first end connected to a pipe for supplying a rinsing liquid from the quartz tube and a second end connected to a sprayer. The sprayer has a first part able to spray the rinsing liquid radially within the quartz tube and a second part able to spray the rinsing liquid radially on the outside of the quartz tube when the quartz tube is in the vertical position within the rinsing and drying enclosure. Preferably, in this case, the rinsing tube is mounted so as to slide longitudinally along its axis within the rinsing and drying enclosure.

Finally, according to a further feature of the invention, the rinsing and drying enclosure comprises means for maintaining the quartz tube in the vertical position. The means is constituted by a first group of elongated supports located essentially in a first horizontal plane and a second group of elongated supports located substantially in a second horizontal plane differing from the first horizontal plane. Preferably, in this case, at least one of the supports is fixed and at least one of the supports traverses a wall of the rinsing and drying enclosure and is longitudinally slidingly mounted.

BRIEF DESCRIPTION OF THE DRAWINGS

Other features and advantages of the invention can be better understood as a result of the following description of a non-limitative embodiment and with reference to the attached drawings.

FIG. 1 shows a means for cleaning quartz tubes. In use, the means would be installed in a space corresponding to a white room of an integrated circuit production shop. In such a (not shown) shop are provided several machines, each of which carries out one of the treatment operations on semiconductor material boards, so as to produce integrated circuits thereon. These machines include furnaces, each having as the essential part a quartz tube serving as a reaction chamber. In such a tube, it is, e.g., possible to effect a tungsten deposit on the boards. At the end of a certain number of operations, the tube is removed from the furnace and introduced into a cleaning means according to the invention to restore it to its initial state.

The means according to the invention comprises a panel 1 separating two shop zones 2, 3, namely a first zone 2 in which the air has an average cleanness and a second zone 3 in which the air has a maximum cleanness and is maintained under a slight overpressure compared with the first zone 2. Obviously, the two shop zones 2, 3 are defined not only by the panel 1, but also by a plurality of not shown tight doors and partitions.

Figure 5:
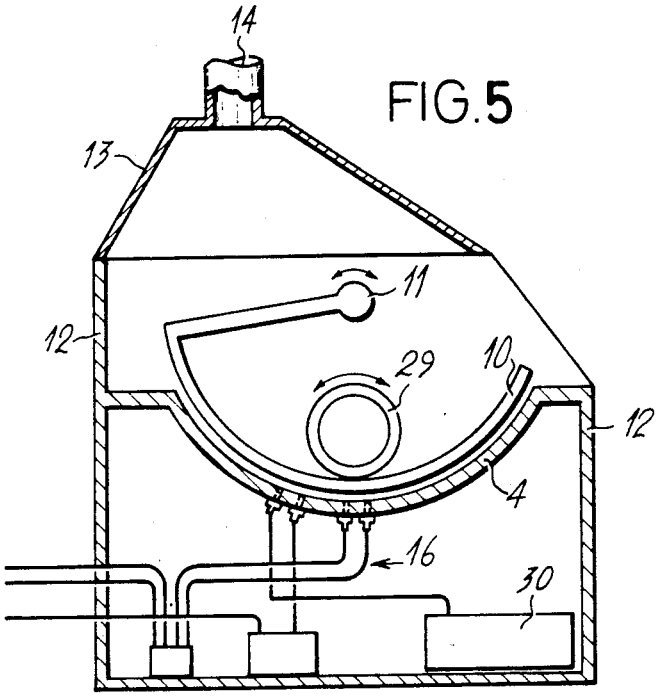
FIG. 5: In cross-section the part according to FIG. 4.

On the side of the panel 1 defining the first zone 2 is fixed an elongated tank 4 the internal length of which exceeds that of the quartz tubes. Preferably, and as best seen in FIG. 5, the elongated tank 5 is horizontally axed, upwardly open, and part-cylindrical. The elongated tank 4 successively contains the chemical product bath or baths for the cleaning and prerinsing of each successive quartz tube which rests in the elongated tank 4 and which is subject to agitation. The panel 1 has an opening 5 in which is lodged a vertically elongated, parallelepipedic enclosure 6 the height of which exceeds the length of the quartz tubes.

The enclosure 6 has a door 7 with a height exceeding the length of the quartz tubes. The door 7 is located on the wall of the enclosure 6 facing the first zone 2. The enclosure 6 has another identical door 8 facing the second zone 3. These two doors 7, 8 can be tightly closed, and in the same way the enclosure 6 is tight, together with its connection to the panel 1. In the same way, when the two doors 7, 8 are closed, the two zones 2, 3 are isolated from one another, which makes it possible to easily maintain the overpressure in the second zone 3. In the vertical position, the enclosure 6 can receive a quartz tube following the washing and prerinsing thereof in the elongated tank 4. This makes it possible to perform a complete rinsing and drying operation thereon.

The means is used in the following way. A quartz tube, the internal surface state of which is no longer satisfactory, is extracted from the furnace in the second zone 3, also called a white room. The quartz tube is then transported into the first zone 2, also called a grey room, by passing it through the enclosure 6 which acts as a lock. That is, the quartz tube is firstly placed in the enclosure 6 by solely opening the door 8. The door 8 is then closed, the door 76 is opened, and the quartz tube is removed from the enclosure 6, so that it is consequently located in zone 2.

The quartz tube is then placed in the elongated tank 4, into which is introduced a certain amount of a liquid product for dissolving the undesirable deposits on the inner face of the tube. The elongated tank 4 is then emptied and filled with water in order to carry out a prerinsing of the quartz tube. This is followed by emptying again.

After that, the quartz tube is again placed in a vertical position in the enclosure 6 whilst only opening the door 7. After again closing door 7, the door having remained closed, the quartz tube is rinsed with the aid of a sprayer which directs deionized water simultaneously onto the inner and outer walls of the quartz tube. The supply of water to the sprayer is then cut off, and hot, dry air is circulated from the bottom to top of the enclosure 6 to dry the quartz tube. This air comes from the white room air intake i.e., it is filtered through absolute filters.

When the quartz tube is dry, the door 8 is opened, and the quartz tube is removed to return it to the corresponding machine.

It can be seen that the enclosure 6 serves both as a rinsing and drying chamber for the quartz tube and as a lock for the passage of the tube from the white room to the grey room and vice versa without any significant consumption of ultra-pure air of the white room, other than the air quantity necessary for drying the quartz tube. It is also clear that the second zone 3 has always remained under an overpressure and has therefore remained isolated from the first zone 2. Moreover, the polluting vapours from the elongated tank 4 have not been able to return to the white room during the tube cleaning operation. It is also possible to install above the elongated tank 4 a high flow rate exhauster hood leading to a renewal of the air in the grey room only (i.e., an only slightly filtered, inexpensive air) without causing air consumption in the white room, where the air is ultra-pure and therefore much more expensive.

Figure 1:
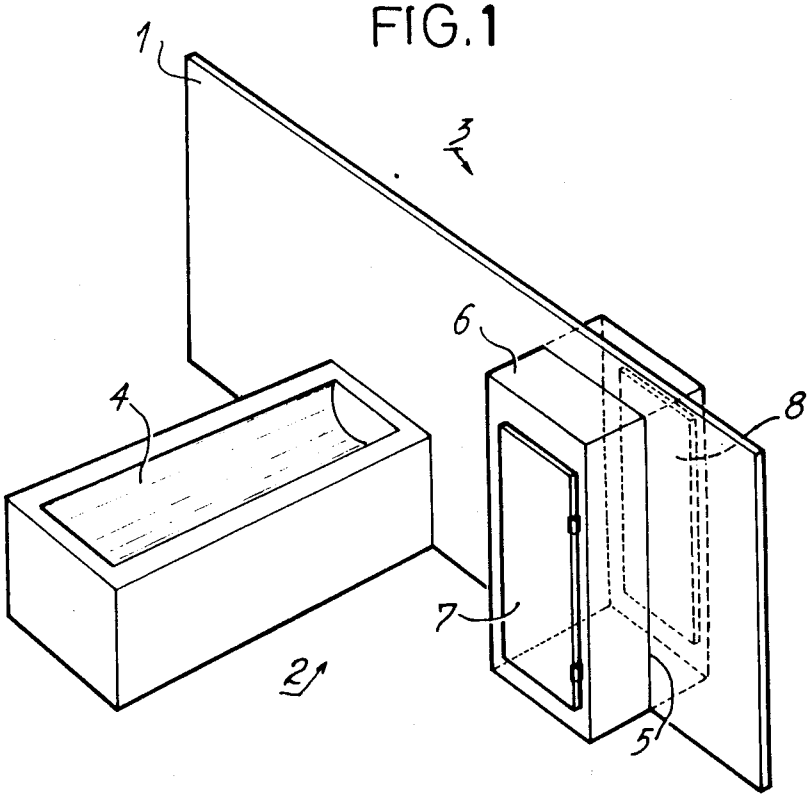
FIG. 1: In perspective view the general diagram of the means.
Figure 2:
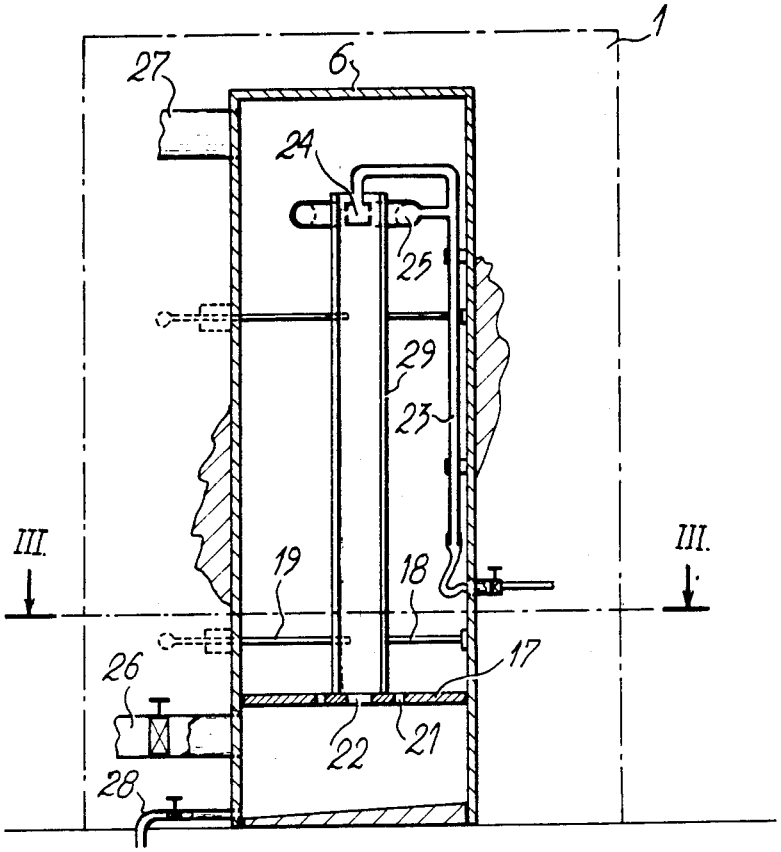
FIG. 2: In section along the line II—II in FIG. 3, that part of the cleaning means corresponding to the rinsing and drying operations.
Figure 3:
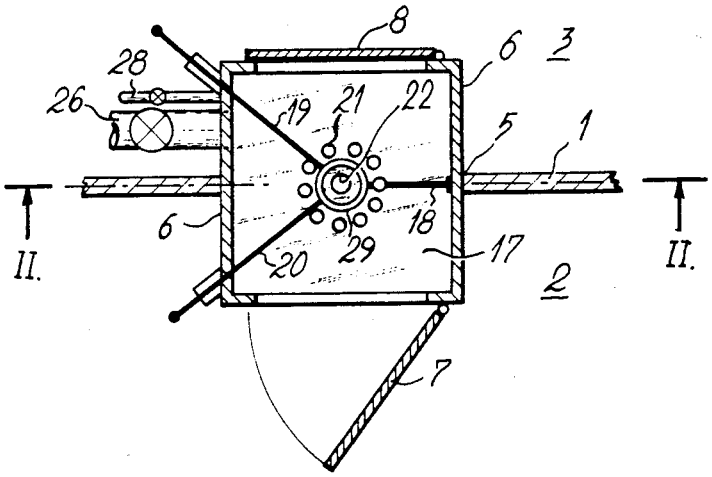
FIG. 3: That part according to FIG. 2 which is in section III—III.

FIGS. 2 and 3 show part of the cleaning means for carrying out the rinsing and drying operations on the quartz tube. It can be seen that the enclosure 6 is disposed in the form of a lock for the passage in the vertical position of a quartz tube 29 between the two zones 2 and 3. The quartz tube 29 is vertically positioned in the centre of the enclosure 6 and consequently rests at mid-height on a planar, horizontal wall 17 forming a separating partition in the enclosure 6. The horizontal wall 17 has a central orifice 22 and a plurality of orifices 21 distributed around and outside the quartz tube 29.

The quartz tube 29 is maintained in the vertical position by means of two groups of three supports 18, 19, 20. For each group, one of the three supports 18 is fixed and positioned horizontally in the extension of the panel 1, the second support 19 is horizontal and passes through the side wall of the enclosure 6 to issue into the second zone 3, and the third support 20 is in a position symmetrical with respect to that of the support 19 relative to the plane of the panel 1 and consequently issues into the first zone 2. The supports 19, 20 are also mounted in a longitudinally sliding manner.

The device also has a deionized filtered water intake connected to a vertical rigid tube 23 in the enclosure 6. The vertical tube 23 slides longitudinally and is connected at its end to a two-part sprayer. The first part 24 of the sprayer projects water radially within the quartz tube 29, and the second part 25 of the sprayer projects the water radially onto the outside of the quartz tube 29.

For treating a quartz tube 29, the door 7 is opened, the sprayer 24, 25 is placed in the top position, the two supports 20 are slid outwards, the quartz tube 29 is installed, the supports 20 are brought into contact with the quartz tube 29 in such a way that it is secured by lateral contact of the two groups of supports 19, 20, 21, the sprayer 24, 25 is lowered in such a way that it surrounds by the inside and outside the top end of the quartz tube 29, door 7 is closed, the water intake is opened for rinsing the quartz tube 29, and the water is removed by gravity through the orifices 21, 22 into the lower part of the enclosure 6, the bottom of which slopes, and then into a drainage pipe 28. When rinsing is completed, the water supply is cut off, and by means of an intake pipe 26 ultra-filtered, hot, dry air is introduced into the lower part of the enclosure 6. The air rises through the orifices 21, 22 in and around the quartz tube 29 and then leaves the enclosure 6 in its upper part through a discharge pipe 27. When the quartz tube 29 is dry, the pipes 26, 27 are closed, the door 8 is opened, the supports 19 are drawn outwards, the sprayer 24, 25 is raised to disengage it from the upper part of the quartz tube 29, the quartz tube 29 is removed, and the door 8 is closed again.

Figure 4:
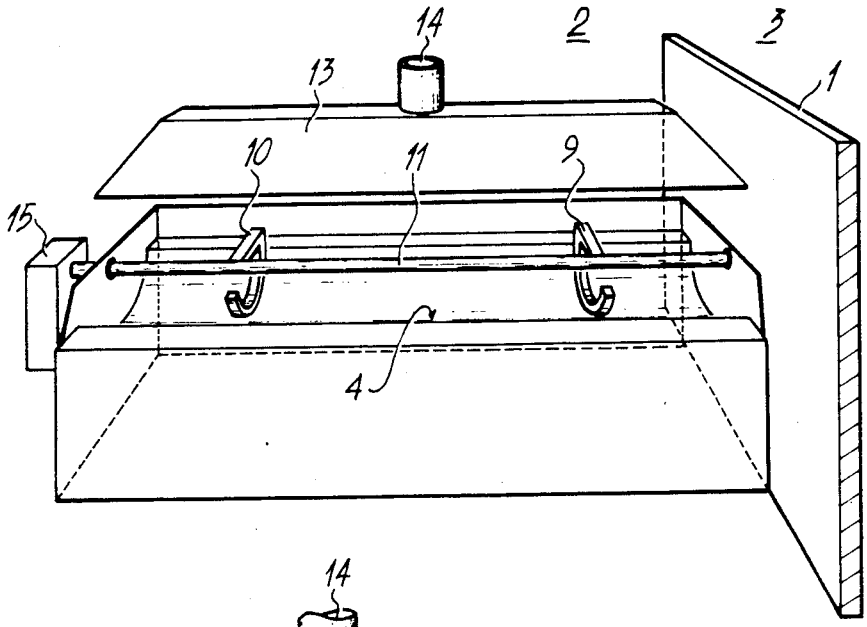
FIG. 4: A perspective view of that part of the cleaning means corresponding to the chemical treatment.

On referring to FIGS. 4 and 5, it is possible to see the part of the quartz tube cleaning means for the chemical cleaning of the tube. This part comprises a frame 12, optionally fixed to the panel 1 by its side part. A shaft 11 is pivotably mounted in the upper part of the frame 12 above the lateral edges of the elongated tank 4. The shaft 11 is centred on the axis of the tank 4. Two arches 9, 10, extend radially from the shaft 11. The arches 9, 10 are in the form of circular arcs centred on the coinciding axes of the shaft 11 and the elongated tank 4, but with a slightly smaller radius than that of the elongated tank 4. The machine also has an exhauster hood 13 connected by an exhaust pipe 14 to the air extraction system, as well as a motor 15 for imparting a periodic oscillating movement to the shaft 11.

The quartz tube 29 to be treated is disposed in the elongated tank 4 on the arches 9, 10. The elongated tank 4 is then partly filled from a reservoir 30 via pipes 16 and not shown pumps, followed by the starting up of the motor 15. The shaft 11 oscillates and through the arches 9, 10 produces an oscillating movement of the quartz tube 29. This is followed by the emptying of the elongated tank 4, the filling thereof with water, and then the draining of the water to carry out a prerinsing of the quartz tube 29. This is followed by the removal of the quartz tube 29 to bring it into the rinsing and drying enclosure 6, the arrangement and operating procedure of which have been described hereinbefore.

Obviously the embodiment described hereinbefore has only been given in a non-limitative manner, and the invention covers all minor modifications and constructional variants.

I claim:

1. Means for restoring the initial cleanness conditions in quartz tubes used as reaction chambers for the production of integrated circuits, said means comprising:

(a) a separating panel defining on one side a first zone in an integrated circuit production shop the air of which is filtered to obtain an average cleanness level and on the other side a second zone in the production ship the air of which is filtered to obtain a maximum cleanness level, said second zone being that in which the main production operations are performed and including production machines using said quartz tubes;

(b) an elongated tank which is upwardly open and positioned against said separating panel in said first zone and which, in use, contains a chemical product or products for eliminating undesirable elements covering said quartz tubes when the quartz tubes are inserted into said elongated tank and;

(c) an elongated enclosure sealingly inserted in an opening made in said separating panel, said elongated enclosure being adapted to receive the quartz tubes and to perform thereon a rinsing operation by sprinkling and drying, said elongated enclosure having a door opening into said first zone and a door opening into said second zone, said two doors facing one another and having a height exceeding the length of the quartz tubes.

2. Means according to claim 1, characterized in that said separating panel, said elongated tank, and said elongated enclosure are produced separately and are rigidly assembled.

3. Means according to claim 1, characterized in that:

(a) said elongated tank is fixed, part-cylindrical, and surmounted by a horizontal shaft the axis of which coincides with the geometrical axis of said elongated tank;

(b) at least two arches are rigidly joined to said horizontal shaft;

(c) said at least two arches have a curvature the center of which coincides with the axis of said elongated tank;

(d) said at least two arches are sized, shaped, and positioned so that a quartz tube being immersed in chemical treatment liquid contained in said elongated tank rests on said at least two arches; and (e) agitation of the quartz tube is obtained by oscillating said horizontal shaft.

4. Means according to claim 3, characterized in that:

(a) said elongated tank and said horizontal shaft are surrounded by a protective enclosure comprising a vapour exhauster hood and (b) an electric motor mechanism for giving oscillating movement to said horizontal shaft is mounted on said protective enclosure.

5. Means according to claim 1, characterized in that:

(a) said elongated enclosure is fitted into said separating panel so as to project on either side thereof by a substantially identical distance;

(b) said elongated tank is located in the vicinity of said elongated enclosure; and (c) the axis of said elongated tank is perpendicular to the vertical plane of said separating panel.

6. Means according to claim 1, characterized in that:

(a) said elongated enclosure comprises a substantially planar, horizontal wall subdividing said elongated enclosure into a lower compartment and an upper compartment;

(b) said elongated enclosure and said horizontal wall are sized, shaped, and positioned so that a quartz tube can rest on said horizontal wall in the vertical position; and (c) said horizontal wall has at least one orifice sized, shaped, and positioned to issue into a quartz tube resting on said horizontal shelf and at least one orifice sized, shaped, and positioned to issue outside a quartz tube resting on said horizontal wall in the vertical position.

7. Means according to claim 6, characterized in that said elongated enclosure also comprises:

(a) an intake pipe for drying gas issuing into said lower compartment and (b) a discharge pipe for discharging the drying gas communicating with said upper compartment.

8. Means according to claim 1, characterized in that said elongated enclosure comprises a rinsing tube having a first ene connected to a pipe for supplying a rinsing liquid and a second end connected to a sprayer having a first part sized, shaped, and positioned to spray the rinsing liquid radially within a quartz tube in said elongated enclosure and a second part sized, shaped, and positioned to spray the rinsing liquid radially on the outside of the quartz tube when the latter is in said elongated enclosure.

9. Means according to claim 8, characterized in that said rinsing tube is mounted so as to slide longitudinally along its axis within said elongated enclosure.

10. Means according to claim 1, characterized in that said elongated enclosure comprises means for maintaining a quartz tube in the vertical position.

11. Means according to claim 10 wherein said means for maintaining a quartz tube in the vertical position comprise a first group of elongated supports located substantially in a first horizontal plane and a second group of elongated supports located substantially in a second horizontal plane differing from the first horizontal plane.

12. Means according to claim 11, characterized in that at least one of said supports is fixed and at least one of said supports traverses a wall of said elongated enclosure and is longitudinally slidingly mounted.

13. Means according to claim 1 wherein said separating panel is vertical.

14. Means according to claim 1 wherein said elongated enclosure is vertically positioned.

15. Means according to claim 1 wherein said elongated enclosure is parallelepipedic in shape.

* * * * *